US005135151A

United States Patent [19]

Logan

[11] Patent Number: 5,135,151

[45] Date of Patent: Aug. 4, 1992

[54] POWER ACTUATED FASTENER TOOL

[75] Inventor: Alan Logan, North Ringwood, Australia

[73] Assignee: Ramset Fasteners (Aust.) Pty. Limited, Victoria, Australia

[21] Appl. No.: 721,592

[22] PCT Filed: Jan. 23, 1990

[86] PCT No.: PCT/AU90/00018

§ 371 Date: Aug. 23, 1991

§ 102(e) Date: Aug. 23, 1991

[87] PCT Pub. No.: WO90/08628

PCT Pub. Date: Aug. 9, 1990

[30] Foreign Application Priority Data

Jan. 25, 1989 [AU] Australia ..... PJ2401

[51] Int. Cl.[5] ..... B25C 1/08

[52] U.S. Cl. ..... 227/9; 42/69.01

[58] Field of Search ..... 42/69.01, 69.02, 65; 227/9

[56] References Cited

U.S. PATENT DOCUMENTS

| | | | |
|---|---|---|---|
| 2,512,638 | 6/1950 | Gaidos | 42/69.01 X |
| 2,945,236 | 7/1960 | Kopf et al. | 42/69.01 X |
| 3,048,850 | 8/1962 | Schilling . | |
| 3,217,441 | 11/1965 | Kerr | 42/69.01 X |
| 3,248,032 | 4/1966 | Bochman . | |
| 3,447,525 | 6/1969 | Cermak et al. | 42/69.02 X |
| 3,548,590 | 12/1970 | Mulno | 227/9 X |
| 3,816,951 | 6/1974 | Larsson | 42/69.02 X |
| 4,598,851 | 7/1986 | Kopf | 227/9 |
| 4,686,786 | 8/1987 | Termet | 227/9 X |

*Primary Examiner*—Frank T. Yost
*Assistant Examiner*—Rinaldi Rada
*Attorney, Agent, or Firm*—Fish & Richardson

[57] ABSTRACT

A power actuated tool for driving a fastener into a work surface includes a firing pin for firing an explosive charge to drive the fastener. The firing pin is held in a cocked position against a spring bias by a rotary sear which is displaced rearwardly during cocking by pressing a barrel against the work surface. In the cocked condition, the sear is aligned with a trigger mechanism which can be actuated to pivot the sear and thereby cause release of the firing pin which is then driven by the spring bias to fire the charge.

7 Claims, 3 Drawing Sheets

POWER ACTUATED FASTENER TOOL

BACKGROUND OF THE INVENTION

The present invention relates to power actuated fastener tools.

Power actuated tools for driving a fastener such as a nail, into a substrate, such as a concrete beam, conventionally comprise a barrel from which the fastener is expelled by means of a piston driven by detonation of an explosive charge. The charge is fired by release of a firing pin after cocking of the tool. In conventional firing mechanisms the firing pin has a slot of sufficient depth to allow a pawl to be contained within the slot. A spring inside the slot biases the pawl to project out of the slot to engage with, and be retained by, a cocking piece. To cock the tool, the forward end of the barrel is pressed hard against the work surface and this results in the rear face of the barrel pushing against the cocking piece which retracts the firing pin against the bias of a firing pin spring. When the firing pin is in the cocked position, a sear which is connected to the trigger is aligned with the pawl. When the trigger is actuated, the sear retracts the pawl into the firing pin, thus releasing the firing pin from the cocking piece whereby the firing pin is driven by the firing pin spring towards the explosive charge to fire the power actuated tool.

The firing pin is of relatively small diameter and the space available for mounting the pawl within the firing pin is limited. For the tool to perform consistantly the fit between the pawl and the slot in the firing pin must be maintained. It has been found that repeated firing results in the pawl wearing against both the cocking piece and the slot wall. This results in the pawl becoming loose within the cocking piece and firing pin. Consequently when the sear applies the upward force upon actuation of the trigger, instead of driving the pawl upward into the slot of the firing pin, the pawl may twist and jam. Thus a greater release force is required which makes actuation of the trigger increasingly difficult. It has also been known for a pawl to jam and then to suddenly, and unexpectedly, release, thus firing the tool, which can be very dangerous.

SUMMARY OF THE INVENTION

According to the present invention, there is provided a power actuated tool for driving a fastener into a substrate, comprising a firing mechanism including a firing pin for firing an explosive charge to drive the fastener from a barrel of the tool, spring means for driving the firing pin, and a rotary sear pivotal between a position in which the sear engages an abutment surface of the pin whereby to entrain the pin and a released position in which the sear is released from the abutment surface whereby to permit driving of the firing pin towards the charge under the bias of the spring means.

DESCRIPTION OF THE PREFERRED EMBODIMENT

An embodiment of the invention will now be described, by way of example only, with reference to the accompanying drawings, in which.

Figure 1:
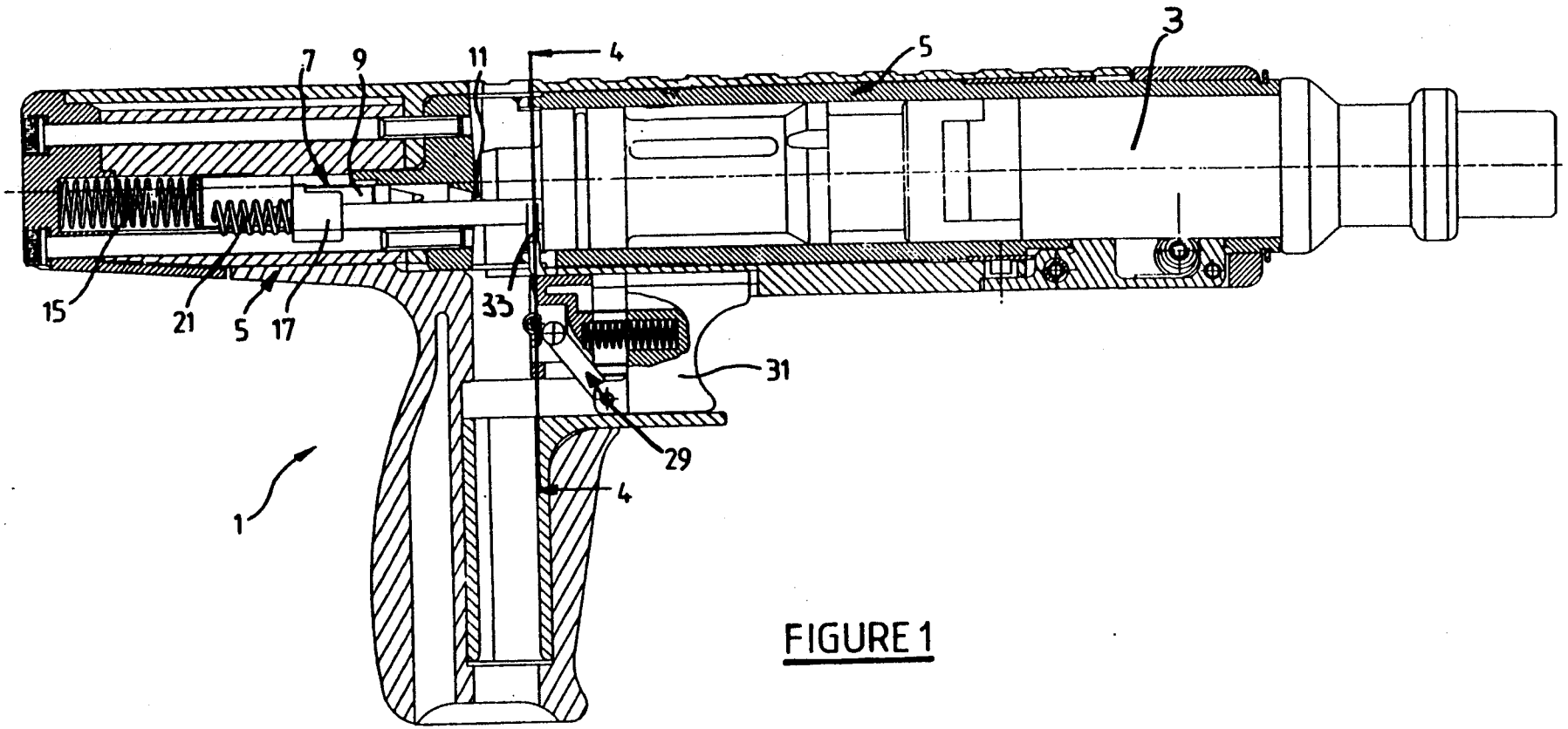
FIG. 1 is a sectional view of a power actuated tool fitted with a firing mechanism in accordance with the present invention, the tool being shown in its cocked condition.
Figure 3:
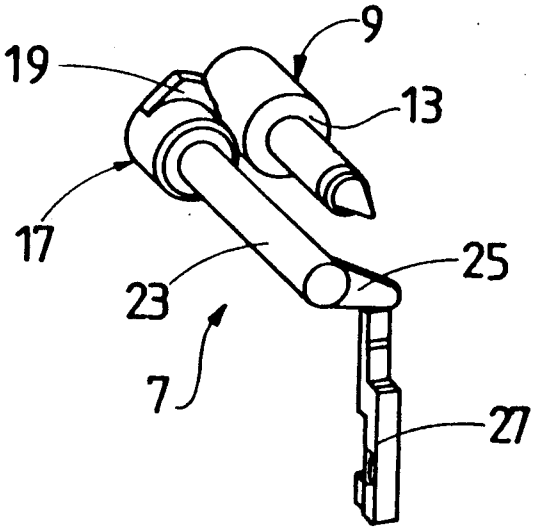
FIG. 3 is a view similar to FIG. 2, but after firing.
Figure 2:
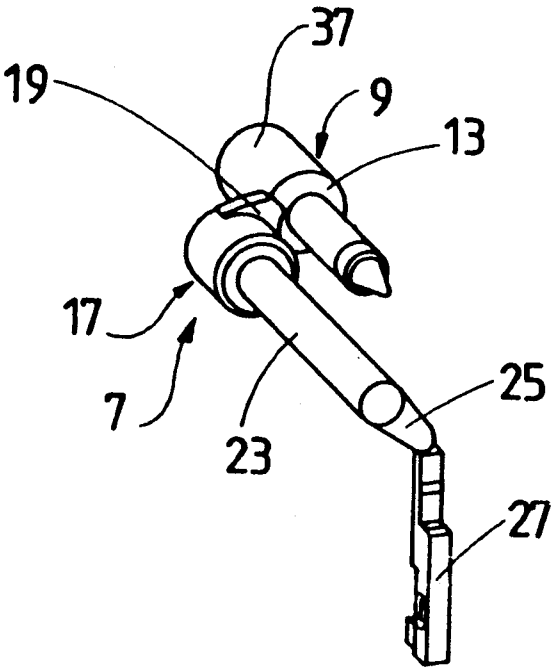
FIG. 2 is a fragmentary schematic view of a firing pin, rotary sear and trigger sear plate in the cocked condition.
Figure 5:
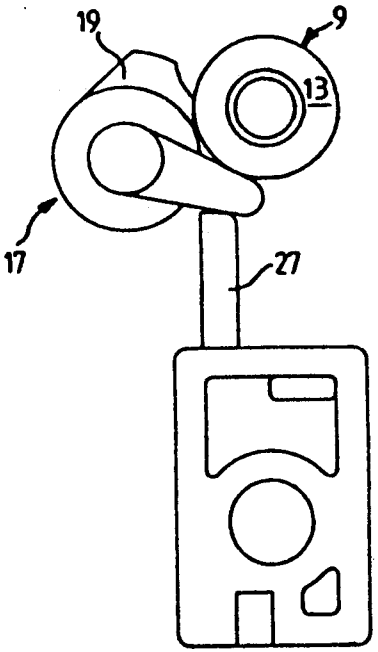
FIG. 5 is a view similar to FIG. 4, but after firing.
Figure 4:
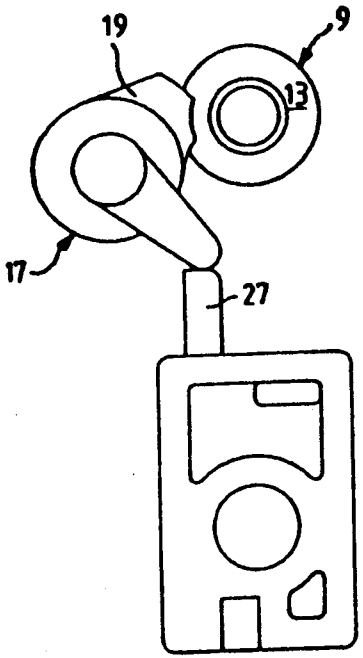
FIG. 4 is a fragmentary schematic view on line 4—4 of FIG. 1 and showing the firing pin, rotary sear, and sear plate in the cocked position.

The power actuated tool 1 comprises a barrel 3 mounted in a receiver assembly 5, and a firing mechanism 7 having a firing pin 9 mounted in the receiver assembly rearwardly of the barrel 3. The barrel 3 houses a piston (not shown) which is actuated by an explosive charge mounted in a charge chamber 11 at the rear of the barrel 3, to drive a fastener within the forward end of the barrel 3 into a substrate such as a beam. The barrel 3 is mounted for axial movement within the receiver assembly 5 and after firing can be moved forwardly of the receiver assembly 5 in order to reset the piston into the rear end of the barrel 3 in preparation for the next firing. Prior to the next firing, a fresh charge is inserted into the charge chamber 11 (either manually or automatically) and the barrel 3 together with the piston is withdrawn into the receiver assembly 5. In order to fire the tool, the forward end of the barrel 3 is pressed against the work surface which has the effect of moving the barrel 3 back further into the receiver assembly 5 which causes cocking of the firing mechanism 7.

The firing pin 9 of the firing mechanism 7 is stepped to provide a forwardly facing abutment face 13. The firing pin 9 is biased in an axially forwards direction by means of a compression spring 15. The firing pin 9 is associated with a rotary sear 17 which is mounted to one side of the firing pin 9 for rectilinear movement parallel to the axis of the firing pin 9 and also for rotation about the axis of rectilinear movement. The sear 17 comprises, at its rear end, a radial lug 19 which co-operates with the firing pin 9 to hold the pin 9 in its cocked position, as will be described. A compression spring 21 acts to apply an axially forwards bias to the rotary sear 17 and is also fixed to both the receiver assembly 5 and the sear 17 so as to apply a torsional bias to the sear 17 in a sense to pivot the lug 19 into engagement with the firing pin 9. The rotary sear 17 is fixedly mounted at the rear end of a cocking rod 23 so that the sear 17 and cocking rod 23 are movable as a unit. A radial lug 25 at the forward end of the cocking rod 23 co-acts with a sear plate 27 of a trigger mechanism 29 in the cocked position, as will be described. The trigger mechanism 29 includes a trigger 31.

In the condition in which the barrel 3 has been withdrawn into the receiver assembly 5 after re-setting of the piston and prior to cocking, the rotary sear 17 is forwardly of the abutment face 13 of the firing pin 9 with the lug 19 being biased towards the firing pin 9 by the torsional bias of the spring 21. The lug 25 at the forward end of the cocking rod 23 is also forwardly of the trigger sear plate 27 in this condition. Upon pushing the forward end of the barrel 3 against the work surface in order to cock the tool, the barrel 3 moves back further into the receiver assembly 5. A stepped abutment surface 33 at the rear end of the barrel 3 engages the forward end of the cocking rod 23 and causes the cocking rod and rotary sear 17 to be displaced rearwardly with the barrel 3 against the bias of the spring 21. During this movement, the lug 19 on the rotary sear 17 engages the forward abutment face 13 on the firing pin 9 and causes retraction of the firing pin 9 against the bias of the compression spring 15. When the barrel 3 is retracted to its maximum extent within the receiver assembly 5, the rear end of the barrel 3 including the charge chamber 11 is firmly against the forward face of the rear part of the receiver assembly 5 housing the firing mechanism 7, and the lug 25 at the forward end of the cocking rod 23 is aligned with the sear plate 27 of the trigger 31. Actuation of the trigger 31 causes linear displacement of the sear plate 27 which engages the lug 25 and pivots the lug 25 and thus the cocking rod 23 and rotary sear 17 in a sense to move the lug 19 angularly away from the firing pin 9, to thereby release the firing pin 9 which is then driven against the charge in the charge chamber 11 under the bias of the compression spring 15.

After firing, the barrel 3 is moved forwardly to reset the piston. The forwards movement of the barrel 3 permits the rotary sear 17 and cocking rod 23 to move forwardly under the bias of the spring 21 whereby the lug 19 on the rotary sear 17 moves along the larger diameter rear portion 37 of the firing pin 9 until it reaches the stepped abutment face 13 at which point the torsional bias of the spring 21 causes the lug 19 to pivot inwardly across the abutment face 13 in preparation for the next firing.

In the embodiment described, to facilitate mounting within the receiver assembly 5, the rotary sear 17 and cocking rod 23 are installed separately and are then locked together to form a unit by means of a connecting pin. In an alternative construction it would, however, be possible to produce the rotary sear 17 and cocking rod 23 as an integral unit which is installed as a whole into the receiver assembly 5. In another alternative construction, the components are installed separately and come into that working relation only during the cocking stroke.

The firing mechanism 7 described is advantageous because there are no components of the release mechanism with the firing pin 9 so the difficulties of mounting the components within the small diameter firing pin 9 and of maintaining the fit between the firing pin 9 and release components are avoided. The firing mechanism 7 also provides a very smooth firing action. This is due to the relatively small angle of rotation of the rotary sear 17. The rotation is typically 20° during the firing operation and this results in only a small increase in the torsional force component of the compression spring 21. Accordingly a much smoother searing action is provided. The compression spring 21 is relatively long so that it can easily handle this small degree of rotation without jamming.

In addition the firing mechanism 7 is wear-compensating as any wear of the lug 19 against the stepped abutment face 13 will automatically be taken up by the spring bias applied to the firing pin 9 by the firing pin spring.

The embodiment has been described by way of example only and modifications are possible within the scope of the invention.

I claim:

1. A power actuated tool for driving a fastener into a substrate, comprising a firing mechanism including a firing pin movable along a predetermined axis of movement for firing an explosive charge to drive the fastener from a barrel of the tool, spring means for driving the firing pin, and a rotary sear pivotable between a position in which the sear engages an abutment surface of the pin whereby to entrain the pin and a released position in which the sear is released from the abutment surface whereby to permit driving of the firing pin along said axis towards the charge under the bias of the spring means, wherein the sear is pivotable about an axis parallel to the axis of movement of the firing pin, the sear is movable in a direction parallel to the axis of movement of the firing pin so as to entrain the pin by engagement with the abutment surface in order to cock the firing mechanism, the barrel is displaceable within a body of the tool, and cocking of the firing mechanism is effected by pressing a front end of the barrel against a work surface to cause relative rearward displacement of the barrel in relation to the body, the sear being displaced rearwardly by the rearward displacement of the barrel to thereby cause rearward displacement of the firing pin against the bias of the spring means with the firing pin being entrained by the sear.

2. A tool according to claim 1 wherein the sear is mounted for rotation with an actuating member, and in the cocked condition of the firing mechanism, the actuating member is aligned with a trigger mechanism such that actuation of the trigger mechanism pivots the actuating member and thereby the sear into its released position.

3. A tool according to claim 2, wherein the sear is mounted at a rear end portion of a cocking rod and the actuating member is mounted at a front end position of the cocking rod, the cocking rod is parallel to the axis of the firing pin, the cocking rod is rotatable to provide the rotation of the sear, and the cocking rod is axially displaceable, and wherein the trigger mechanism includes a sear plate, the actuating member of the sear being movable into alignment with the sear plate when the cocking rod is moved rearwardly on cocking, and actuation of a trigger of the trigger mechanism causing engagement of the sear plate with the actuating member whereby to pivot the sear into its released position.

4. A tool according to claim 3, comprising torsion spring means biasing the sear into its engaged position.

5. A tool according to claim 4, wherein the torsion spring means comprises a compression spring which applies a torsional bias to the sear and also applies a forwards axial bias to the sear.

6. A tool according to claim 3, wherein the sear is in the form of a lug extending radially of the pivotal axis of the cocking pin to engage the abutment surface of the firing pin.

7. A tool according to claim 3, wherein the abutment surface of the firing pin is defined by a forward face formed on a step in the firing pin.

* * * * *